US009719508B2

(12) United States Patent
Salmela et al.

(10) Patent No.: US 9,719,508 B2
(45) Date of Patent: Aug. 1, 2017

(54) FLEXIBLE IMPELLER PUMP

(71) Applicant: Automatic Bar Controls, Inc., Vacaville, CA (US)

(72) Inventors: Juha K. Salmela, Citrus Heights, CA (US); James M. Tuyls, Vacaville, CA (US); Richard A. Martindale, Vacaville, CA (US)

(73) Assignee: AUTOMATIC BAR CONTROL, INC., Vacaville, CA (US)

( * ) Notice: Subject to any disclaimer, the term of this patent is extended or adjusted under 35 U.S.C. 154(b) by 489 days.

(21) Appl. No.: 13/857,963

(22) Filed: Apr. 5, 2013

(65) Prior Publication Data

US 2014/0301833 A1 Oct. 9, 2014

(51) Int. Cl.
*F04B 35/04* (2006.01)
*F04C 5/00* (2006.01)

(52) U.S. Cl.
CPC ..... *F04C 5/00* (2013.01); *F04C 2240/802* (2013.01); *F04C 2270/16* (2013.01); *F05C 2203/08* (2013.01)

(58) Field of Classification Search
CPC .. F04C 2230/91; F04C 5/00; F04C 2240/802; F04C 2270/16; F04D 17/10
USPC ..... 418/154, 152, 168.1, 153
See application file for complete search history.

(56) References Cited

U.S. PATENT DOCUMENTS

| | | | | |
|---|---|---|---|---|
| 3,218,983 | A * | 11/1965 | Parrett | 418/154 |
| 3,303,791 | A * | 2/1967 | Doble | 418/154 |
| 4,741,091 | A * | 5/1988 | Settles | B23P 9/02 192/110 R |
| 4,836,759 | A * | 6/1989 | Lloyd | 418/56 |
| 6,241,494 | B1 * | 6/2001 | Pafitis | E21B 4/02 175/107 |

FOREIGN PATENT DOCUMENTS

JP 63186981 A * 8/1988

* cited by examiner

*Primary Examiner* — Mark Laurenzi
*Assistant Examiner* — Anthony Ayala Delgado
(74) *Attorney, Agent, or Firm* — Kilpatrick Townsend & Stockton LLP

(57) ABSTRACT

A flexible impeller pump includes improved flexible impeller geometry, an impeller shaft having protruding portions that produce a stronger and more durable connection between the impeller shaft and the flexible impeller, a smoother housing cam surface, and wear resistant surfaces that are disposed between end faces of the flexible impeller and adjacent housing end walls.

13 Claims, 12 Drawing Sheets

SECTION A-A

FLEXIBLE IMPELLER PUMP

BACKGROUND

Flexible impeller pumps are often used to pump fluids. In the flexible impeller pump 10 illustrated in FIG. 1, an impellor 12 having flexible vanes 14 extending radially from a central hub is mounted for rotation within an opening of a housing 16. The impellor 12 is mounted to a shaft, which is mounted for rotation relative to the housing 16 about an axis. The opening is in fluid communication with an inlet 18 and an outlet 20. As the impellor 12 is rotated (clockwise relative to the view direction of FIG. 1), tips of the flexible vanes interface with sidewalls of the opening to draw fluid from the inlet 18 and discharge the fluid to the outlet 20. The housing includes a cam portion 22, which has a sidewall that is disposed closer to the axis than the other sidewalls of the opening, thereby causing increased bending of the flexible vanes 14 as they pass by the cam portion 22. As the impellor 12 rotates, each flexible vane 14 exits the cam portion 22 in the vicinity of the inlet 18, travels around an annular portion of the opening to the outlet 20, and then reengages the cam portion 22 to repeat the cycle. Upon exiting the cam portion 22, a flexible vane 14 straightens thereby increasing the volume bounded between the flexible vane 14 and the adjacent trailing flexible vane so as to draw fluid from the inlet 18 into the space between the flexible vane and the adjacent trailing flexible vane. The fluid in the space is then propelled around the opening to the outlet 20 by the impellor vanes. At the outlet 20, the flexible vane reengages the cam portion 22 and is cause to undergo increased bending, thereby decreasing the volume bounded between the vane and the adjacent trailing vane so as to discharge fluid from the space to the outlet 20. A suction created by the straightening of the vanes upon leaving the cam portion enables self priming of the pump 10 by allowing atmospheric pressure to push the liquid into the pump 10.

Existing flexible impeller pumps, however, suffer from a variety of common problems. For example, as illustrated in FIG. 2, the repetitive bending of the flexible vanes can lead to fracture of the vanes and/or permanent bowing of the vanes. The sliding of the tips of the flexible vanes along the sidewalls of the housing, especially along the sidewall of the cam portion, can lead to localized wearing, pitting, and/or ripping of the tips of the flexible vanes.

In addition, relative motion between the end faces of the impellor and adjacent end walls of the housing can result in additional wear damage to the housing end walls. Wear to the housing end walls can be especially significant where the flexible impeller pump is used to transfer abrasive fluids. For example, as a non-limiting example, many dispensable edible fluids contain particulate, some of which are abrasive. And many food dispensing pumps have plastic housings. The plastic end walls of such pump housings can experience significant amounts of wear due to the presence of such abrasive components.

Thus, there is believed to be a need for improved flexible impeller pumps, particularly flexible impeller pumps suitable for use with abrasive fluids, such as dispensable foods having abrasive components.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Improved flexible impeller pumps are disclosed. In many embodiments, wear resistant surfaces are included in the flexible impeller pump such that each end face of the flexible impeller is immediately adjacent to one of the wear resistant surfaces. In many embodiments, the flexible impeller pump includes an impeller shaft that includes an impeller interface portion having one or more protruding portions shaped to interlock with the flexible impeller. And in many embodiments, the flexible impeller pump includes a flexible impeller with improved vane to main body transitions. The wear resistant surfaces decrease the amount of housing end plate wear that occurs, especially when the flexible impeller pump is used to transfer fluids having abrasive components. The wear resistant surfaces may also support the use of moldable housing materials, such as plastic. The one or more protruding portions of the impeller shaft provide a more secure coupling between the impeller shaft and the flexible impeller as compared to existing flexible impeller/shaft assemblies. The more secure coupling is especially beneficial when the flexible impeller pump is used to pump hot abrasive fluids, which may tend to cause the flexible impeller to get hot and become detached from the impeller shaft in existing flexible impeller/shaft assemblies.

Thus, in one aspect, a flexible impeller pump is provided. The flexible impeller pump includes a shaft configured to rotate about an axis thereof; a rotor that is coaxial with and attached to the shaft; a housing defining an opening with the rotor disposed therein, and a first wear resistant surface. The rotor is configured to be rotated by the shaft. The rotor includes a plurality of vanes extending substantially radially there from. The rotor has a first end face and a second end face opposite to the first end face. The first and second end faces are perpendicular to the axis. The housing defines a fluid inlet and a fluid outlet. The opening includes a cam surface operatically disposed between the outlet and the inlet. The cam surface is configured to interfere with the vanes to bend the vanes toward the outlet. The housing further includes a first end wall and a second end wall that bound the opening in an axial direction thereof. The first wear resistant surface is disposed between the rotor first end face and the first end wall. The first wear resistant surface resides immediately adjacent to a majority of the area of the rotor first end face. The first wear resistant surface has greater wear resistance than the housing first end wall.

In many embodiments, the first wear resistant surface is immediately adjacent to more than 50 percent of the area of the rotor first end face. For example, the first wear resistant surface can reside immediately adjacent to at least 90 percent of the area of the rotor first end face. As another example, the first wear resistant surface can reside immediately adjacent to at least 95 percent of the area of the rotor first end face.

A wear resistant member can provide the first wear resistant surface. For example, the housing first end wall can have a recess that at least partially receives an insert having the wear resistant surface. In many embodiments, the insert includes a ceramic material. For example, the ceramic material can include a food grade ceramic material.

In many embodiments, the flexible impeller pump includes a second wear resistant surface disposed between the rotor second end face and the housing second end wall. The second wear resistant surface resides immediately adjacent to a majority of the area of the rotor second end face. The second wear resistant surface has a greater wear resistance than the housing second end wall.

In many embodiments, the cam surface is smoothly shaped. For example, the cam surface can have no convex curvature.

In another aspect, a flexible impeller pump is provided. The flexible impeller pump includes a shaft configured to rotate about an axis thereof; a rotor that is coaxial with and attached to the shaft; and a housing defining an opening with the rotor disposed therein. The shaft includes first and second cylindrical portions and an impeller interface portion disposed there between. The impeller interface portion includes a portion that protrudes by at least 10 percent of the cross-sectional dimension of a central portion of the shaft impeller interface portion. The rotor is attached to the shaft interface portion. The rotor is configured to be rotated by the shaft. The rotor includes a main body and a plurality of vanes extending substantially radially from the main body. The housing defines a fluid inlet and a fluid outlet. The opening includes a cam surface operationally disposed between the outlet and the inlet. The cam surface is configured to interfere with the vanes to bend the vanes toward the outlet.

In many embodiments, the protruding portion of the shaft protrudes from the central portion by more than 10 percent of the central portion cross-sectional dimension. For example, the protruding portion of the shaft can protrude from the central portion by at least 20 percent of the central portion cross-sectional dimension.

In many embodiments, the shaft impeller interface portion includes a plurality of protruding portions distributed around the shaft. Each of the protruding portions protrudes by at least 10 percent of the cross-sectional dimension of the central portion of the shaft impeller interface portion. Each of the protruding portions can be aligned with one of the vanes. The number of protruding portions can be equal to or greater than the number of the vanes. The shaft impeller interface portion can include a plurality of rows of the protruding portions. In many embodiments, each of the protruding portions has a constant cross-sectional shape and is aligned with the shaft axis.

In many embodiments, the flexible impeller pump includes a flexible impeller with improved vane to main body transitions. For example, each portion of the rotor main body disposed between a pair of adjacent vanes can have an external surface having no convex curvature from one of the pair of the vanes to the other of the pair of the vanes. In many embodiments, each of the main body external surfaces has a concave shape with a substantially constant radius.

In many embodiments, the cam surface is smoothly shaped. For example, the cam surface can have no convex curvature.

In another aspect, a flexible impeller pump is provided. The flexible impeller pump includes a shaft configured to rotate about an axis thereof, a rotor that is coaxial with and attached to the shaft, and a housing defining an opening with the rotor disposed therein. The rotor is configured to be rotated by the shaft. The rotor includes a plurality of vanes extending there from. The housing defines a fluid inlet and a fluid outlet. The opening includes a cam surface operationally disposed between the outlet and the inlet. The cam surface is configured to interfere with the vanes to vend the vanes toward the outlet. The cam surface has no convex curvature surface that interfaces with the vanes.

For a fuller understanding of the nature and advantages of the present invention, reference should be made to the ensuing detailed description and accompanying drawings. Other aspects, objects and advantages of the invention will be apparent from the drawings and detailed description that follows.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
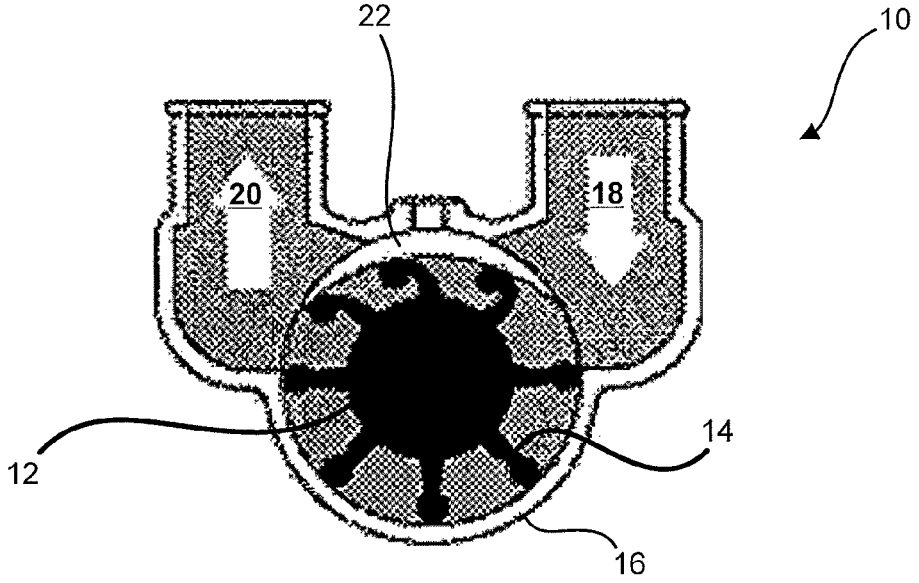
FIG. 1 PRIOR ART
FIG. 1 illustrates the operation of a flexible impeller pump.
Figure 2:
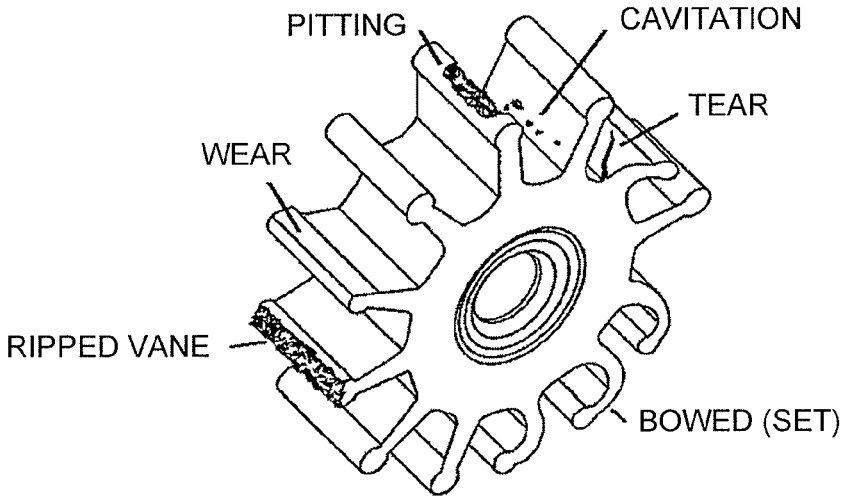
FIG. 2 PRIOR ART
FIG. 2 is a perspective view of a flexible impeller illustrating common types of damage that can occur.
Figure 3:
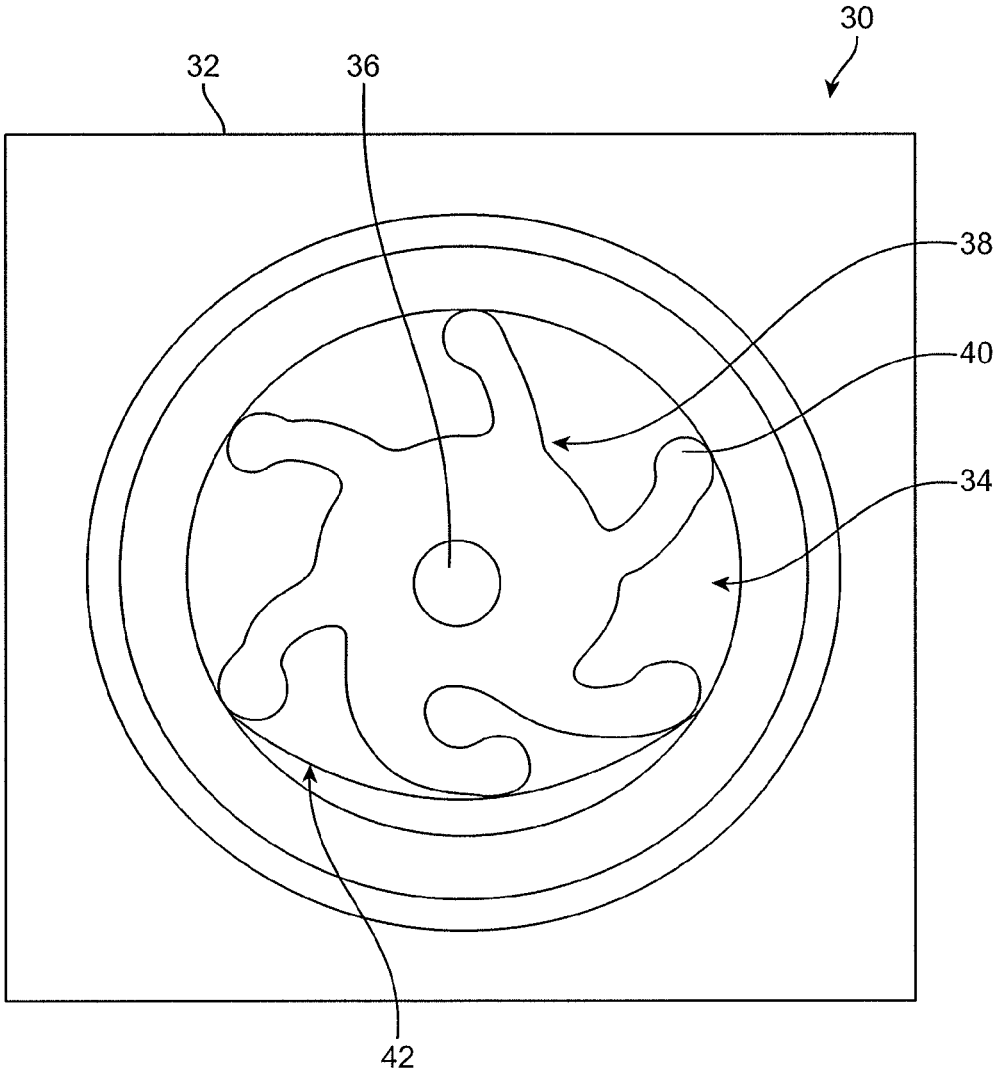
FIG. 3 shows components of an existing flexible impeller pump illustrating deformation of the flexible impeller.

Referring now to the drawings, in which like reference numerals represent like parts throughout the several views, FIG. 3 shows the configuration of an existing flexible impeller pump 30. The impeller pump 30 includes a housing 32 defining an opening 34, an impeller shaft 36 mounted to rotate relative to the housing 32, and a flexible impeller 38 mounted to the impeller shaft 36 to be rotated by the impeller shaft 36. The flexible impeller 38 includes vanes 40 that extend radially from a cylindrically-shaped main body of the flexible impeller 38. The opening 34 is sized to induce significant amount of bending in each of the vanes 40. The geometry of the transition between each of the vanes and the main body results in significant stress concentrations at the roots of each of the vanes. The opening 34 includes a cam surface 42, which induces yet further levels of bending in the vanes as the vanes move over the cam surface 42 during rotation of the flexible impeller 38 within the opening. The geometry of the opening 34, including the cam surface 42, coupled with the geometry of the flexible impeller 38, results in high stress cycles in the flexible impeller, particularly at the roots of the vanes, as well as high contact stresses between the tips of the vanes and the cam surface 42. These high stress cycles and high contact stresses contribute, over time, to damaging the impeller 38.

Figure 4A:
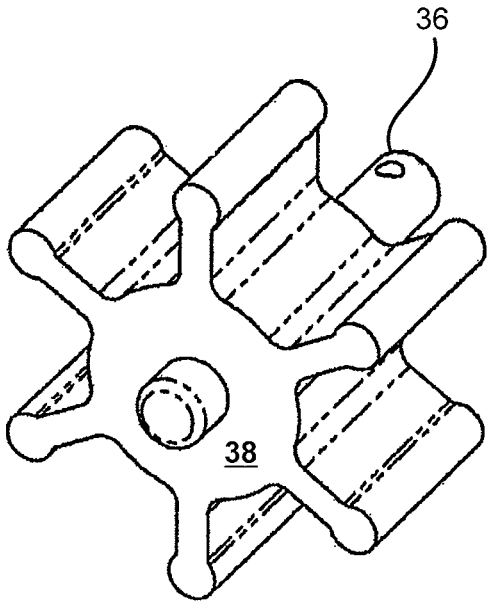
FIG. 4A is a perspective view of an existing impeller assembly that includes a flexible impeller attached to an impeller shaft.
Figure 4B:
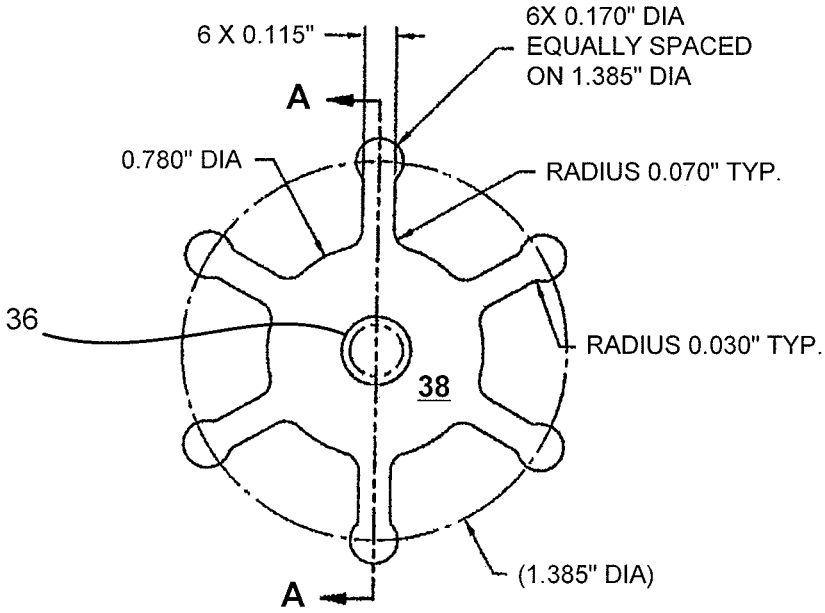
FIG. 4B is an end view of the impeller assembly of FIG. 4A.
Figure 4C:
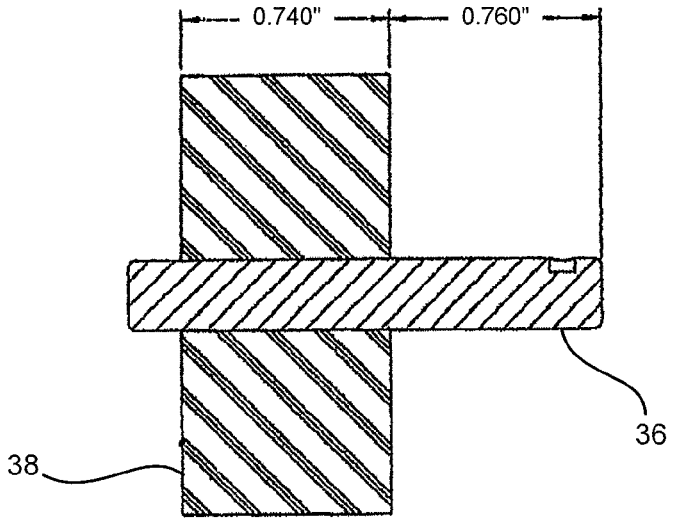
FIG. 4C is a cross-sectional view of the impeller assembly of FIG. 4A.
Figure 4D:
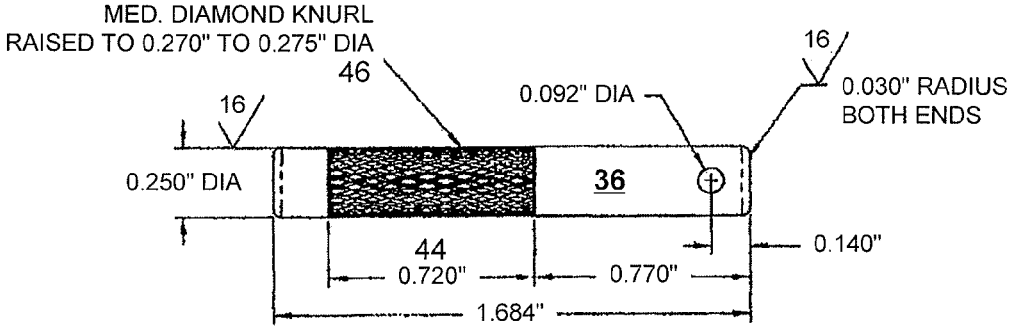
FIG. 4D is a side view of the impeller shaft of the impeller assembly of FIG. 4A.

FIGS. 4A through 4D illustrate details of the attachment of the existing flexible impeller 38 to the existing impeller shaft 36. The flexible impeller 38 is coaxial with and attached to the impeller shaft 36. As shown in FIG. 4D, the impeller shaft 36 has an impeller interface portion 44 that includes a knurled surface 46 that interfaces with the flexible impeller 38. The flexible impeller 38 can be bonded to the impeller shaft 36 over the knurled surface 46. The flexible impeller 38 can, however, become detached from the impeller shaft 36 over time, particularly when the flexible impeller pump is used to move a hot, viscous, and abrasive fluid (e.g., a hot food condiment having an abrasive component). The heat may weaken the bond between the flexible impeller 38 and the knurled surface 46. The viscosity and abrasiveness of the fluid may increase the torque required to rotate the flexible impeller 38, thereby increasing the torsion that must be transferred from the impeller shaft 36 to the flexible impeller 38. The combination of reduced bond strength and increased load transfer may result in detachment of the flexible impeller 38 from the impeller shaft 36.

Improved Impeller and Shaft Assembly

Figure 5A:
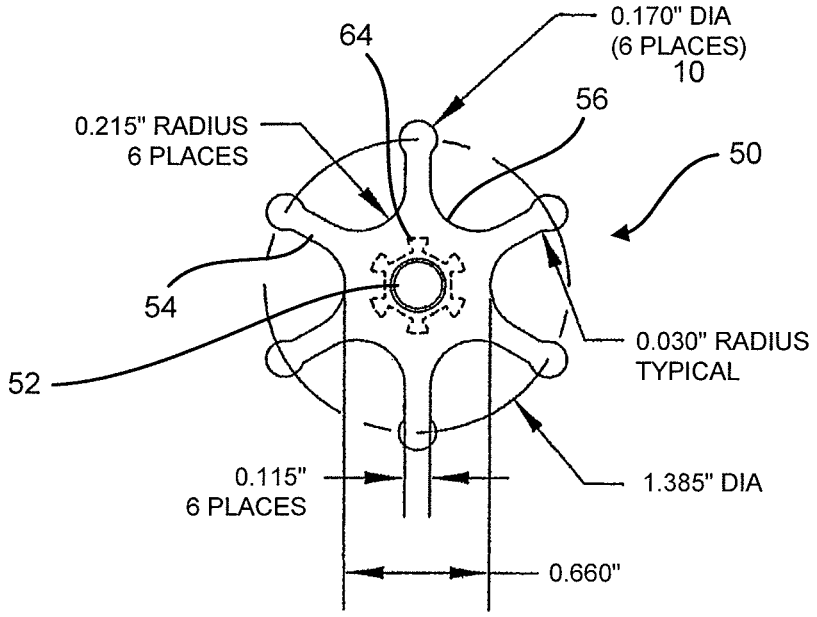
FIG. 5A is an end view of an impeller assembly that includes an improved flexible impeller mounted to an improved impeller shaft, in accordance with many embodiments.

FIG. 5A shows an improved flexible impeller 50 mounted to an improved impeller shaft 52, in accordance with many embodiments. The improved flexible impeller 50 includes six vanes 54 that extend radially from a main body 56. The flexible impeller 50 includes improved vane to main body transition regions, which include larger fillet radiuses relative to the fillet radiuses of the flexible impeller 38—0.215 inch for the improved flexible impeller 50 as compared to 0.070 inch for the existing flexible impeller 38 (illustrated in FIG. 4B). The larger fillet radiuses of the flexible impeller 50 reduce the stress concentrations at the root of the vanes 54, thereby reducing the resulting root stress generated by the bending of the vanes 54. While the flexible impeller 50 employs a single constant radius that extends from one vane to the next, variable curvature can also be used. For example, a variable curvature concave surface that extends from one vane to the next and includes no regions of convex curvature can also be used to reduce the stress concentrations at the root of the vanes 54. In contrast, in the existing flexible impeller 38, the external surface of the main body between each vane has a cylindrical shape (0.780 inch diameter), thereby interposing an area of convex curvature between the 0.070 inch fillet radiuses.

The improved flexible impeller 50 can be made from a suitable material. For example, when the pump is used to transfer a hot food condiment, the flexible impeller can be made from a suitable food grade material (e.g., FDA grade Viton Shore A, DUR075 material).

Figure 5B:
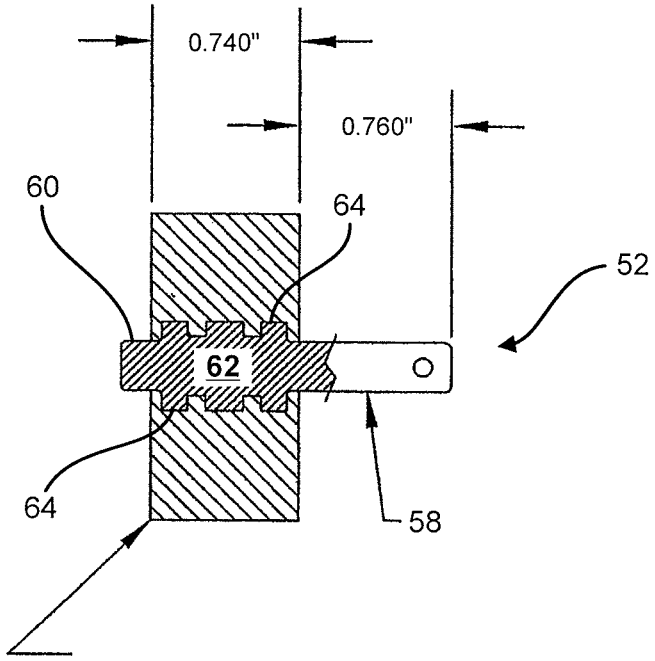
FIG. 5B is a cross-sectional view of the impeller assembly of FIG. 5A.
Figure 5C:
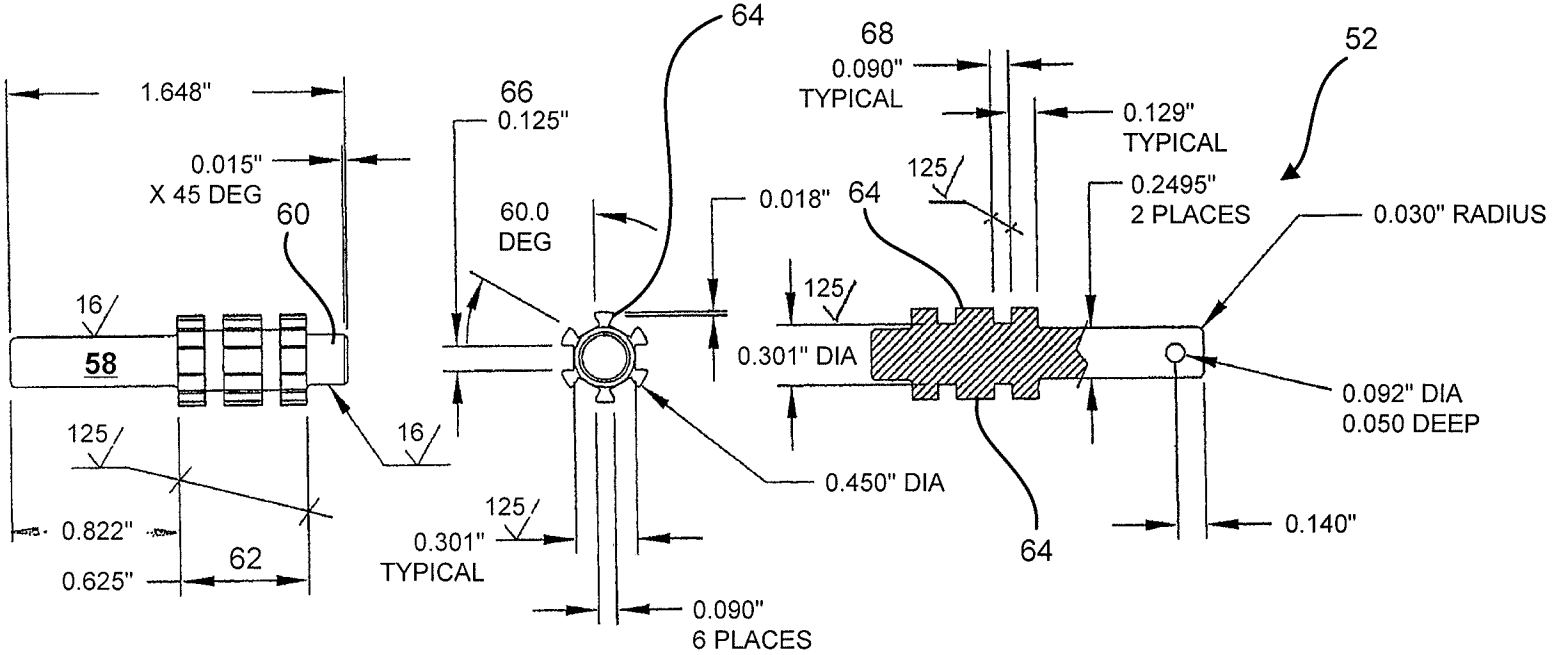
FIG. 5C includes various views of the improved impeller shaft of FIG. 5A.

As shown in FIGS. 5A through 5C, the improved impeller shaft 52 includes a first cylindrical portion 58, a second cylindrical portion 60, and an impeller interface portion 62 disposed there between. The impeller interface portion 62 includes a plurality of protruding portions 64. In the embodiment shown, each of the protruding portions 64 has a constant approximately trapezoid-shaped cross section and extends along the impeller shaft 52 parallel to the centerline of the impeller shaft 52. The protruding portions 64 have an outside diameter of 0.450 inches and extend from a 0.301 inch diameter base. In the embodiment shown, eighteen protruding portions (three rows of six) are equally distributed around the shaft and are separated by six slots 66 (0.125 inch wide) that extend along the impeller shaft 52 and two radial grooves 68 (0.090 inch wide) that separate the rows. The slots 66, the grooves 68, and the distributed protruding portions 64 combine to define a stepped interface between the flexible impeller 50 and the impeller shaft 52. The stepped interface provides increased bonding area and provides a more positive mechanical connection between the impeller shaft 52 and the flexible impeller 50 that is capable of transmitting torque and preventing axial movement of the flexible impeller 50 along the impeller shaft 52 even in the absence of a bond between the impeller shaft 52 and the flexible impeller 50.

In the embodiment shown, each of the eighteen protruding portions 64 extends from the base by approximately 25 percent of the cross-sectional dimension of the base. Other suitable number and size of protruding portions can also be used. For example, one or more protruding portions that protrude by at least 10 percent of the cross-sectional dimension of a central portion of the shaft impeller interface portion can be used. And in many embodiments, the protruding portion(s) protrudes from the central portion by at least 20 percent of the central portion cross-sectional dimension.

As shown in FIG. 5A, each group of three of the protruding portions (one protruding portion in each of the three rows) is aligned with one of the six vanes 54 of the flexible impeller 50. By aligning the vanes 54 with the protruding portions 64, the protruding portions 64 are disposed under the vanes 54 where the local thickness of the main body of the flexible impeller 50 is greater and therefore provides greater room to accommodate the protruding portions 64.

The impeller shaft 52 can be made from a suitable material. For example, when the pump is used to transfer a hot food condiment, the impeller shaft 52 can be made from a suitable food grade material (e.g., 300 series stainless steel).

Improved Housing Assembly

Figure 6:
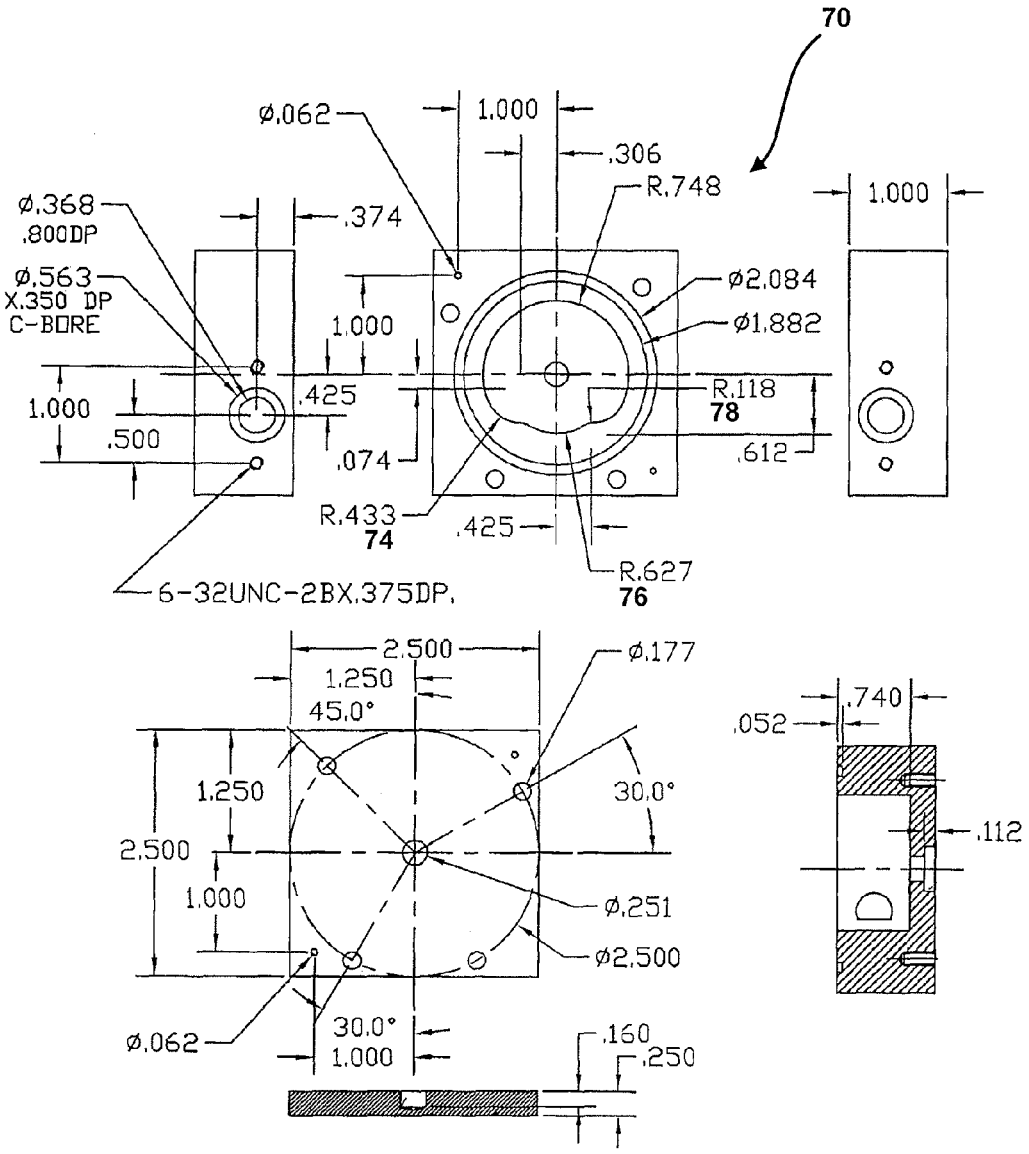
FIG. 6 includes various views of an existing housing assembly of a flexible impeller pump.
Figure 7:
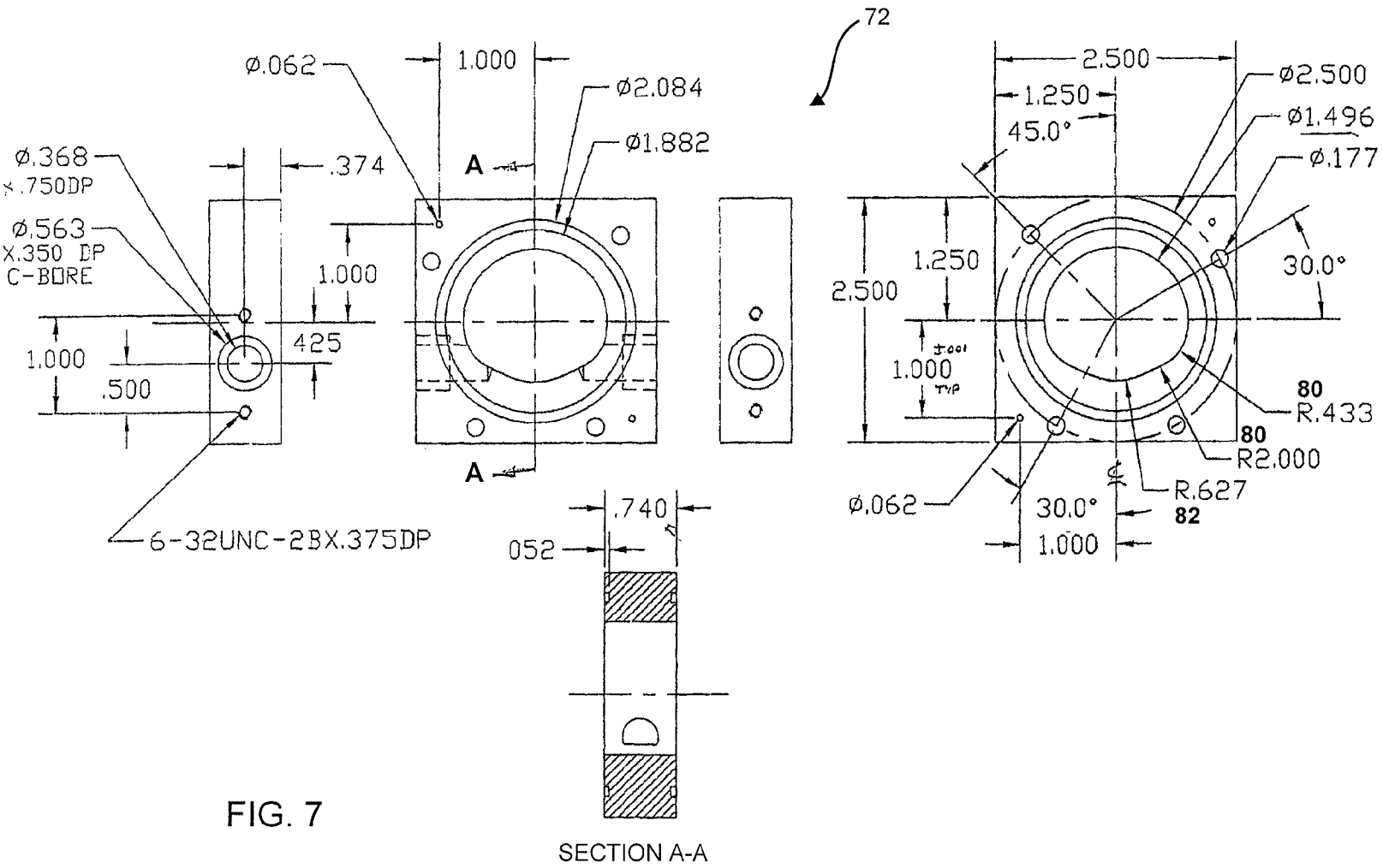
FIG. 7 includes various views of an improved housing assembly of a flexible impeller pump, in accordance with many embodiments.

FIG. 6 shows an existing impeller pump housing assembly 70 for comparison with an improved housing assembly 72 that is shown in FIG. 7. In both of the housing assemblies 70, 72, a housing defines an opening in which the flexible impeller is disposed. The opening includes a main cylindrical portion (0.748 inch radius) and a cam portion. In the existing housing assembly 70, the cam portion has an aggressive concave ramp surface 74 (0.433 inch radius) at both ends, a central concave section 76 (0.627 inch radius) with an intermediate convex surface 78 (0.118 inch radius) disposed between each end ramp surface 74 and the central concave section 76. In contrast, in the improved housing assembly 72, the cam portion has no convex curvature. A less aggressive ramp surface 80 is disposed on both sides of a central concave section 82. The less aggressive ramp surface 80 includes only concave surfaces (a 0.433 inch curved section joined to a 2.000 inch curved section). Accordingly, when the vanes are bent by the cam portion in the improved housing assembly 72, the vanes do not have to travel over an area of convex curvature (e.g., the intermediate convex surface 78 in the existing housing assembly 70), and are therefore less likely to break or experience early wear.

Figure 8:
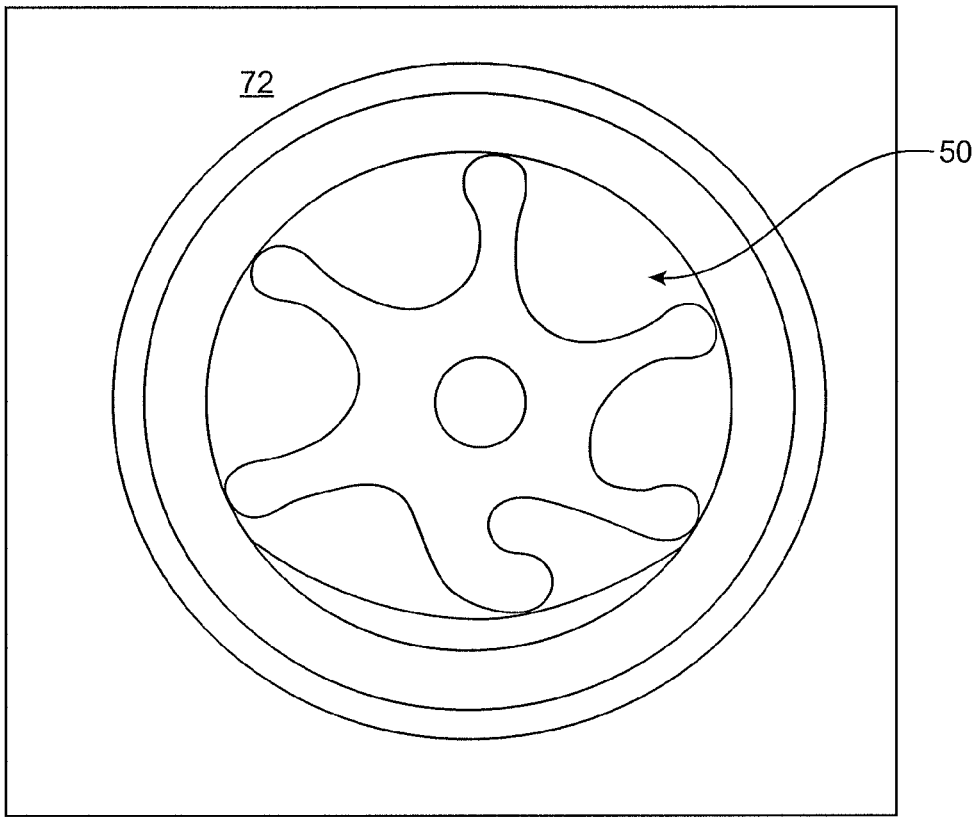
FIG. 8 shows components of an improved flexible impeller pump illustrating deformation of the improved flexible impeller, in accordance with many embodiments.

FIG. 8 shows deformation of the improved flexible impeller 50, which is disposed in the improved housing assembly 72, in accordance with many embodiments. In contrast to the existing impeller pump shown in FIG. 3, the improved flexible impeller 50 is subjected to less severe localized strain, thereby decreasing the failure rate of the improved flexible impeller 50 relative to the existing flexible impeller 38.

The housing assembly 72 can be made from a suitable material. For example, when the pump is used to transfer a hot food condiment, the housing assembly 72 can be made from a suitable food grade material (e.g., acetal thermoplastic with 13 percent Teflon FDA grade).

Figure 9:
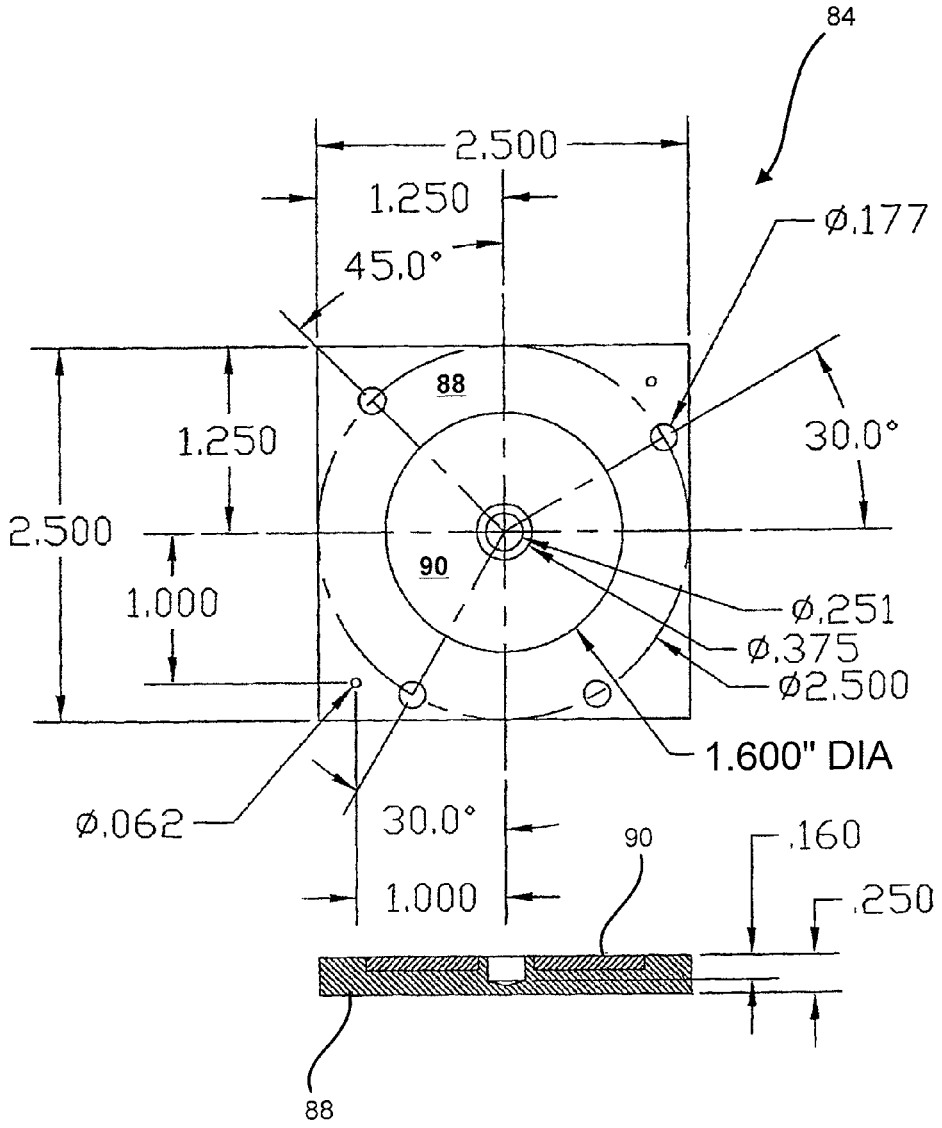
FIG. 9 includes a top view and a cross-sectional view of a housing end plate assembly that includes a wear resistant insert, in accordance with many embodiments.
Figure 10:
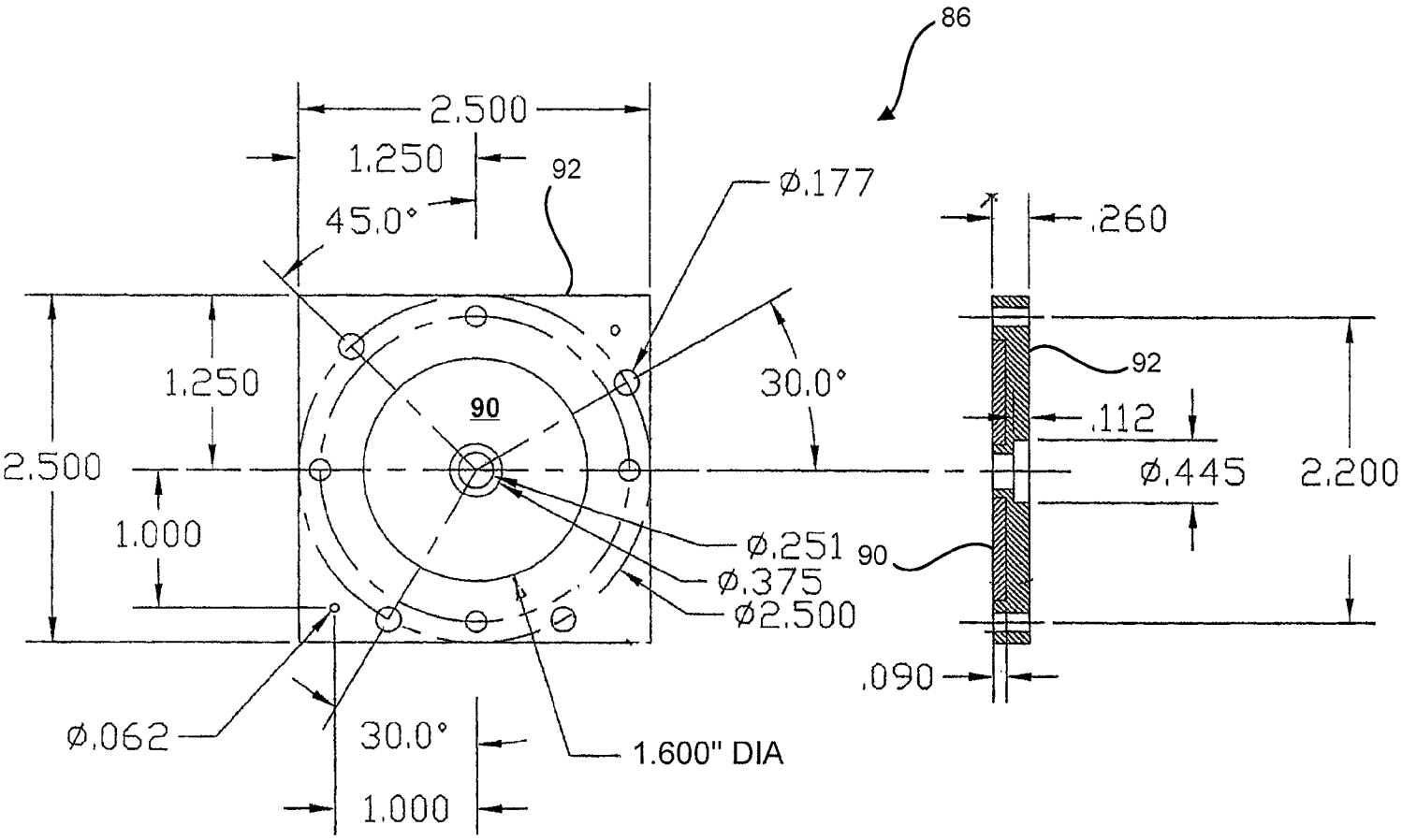
FIG. 10 includes a top view and a cross-sectional view of a housing base plate assembly that includes a wear resistant insert, in accordance with many embodiments.
Figure 11:
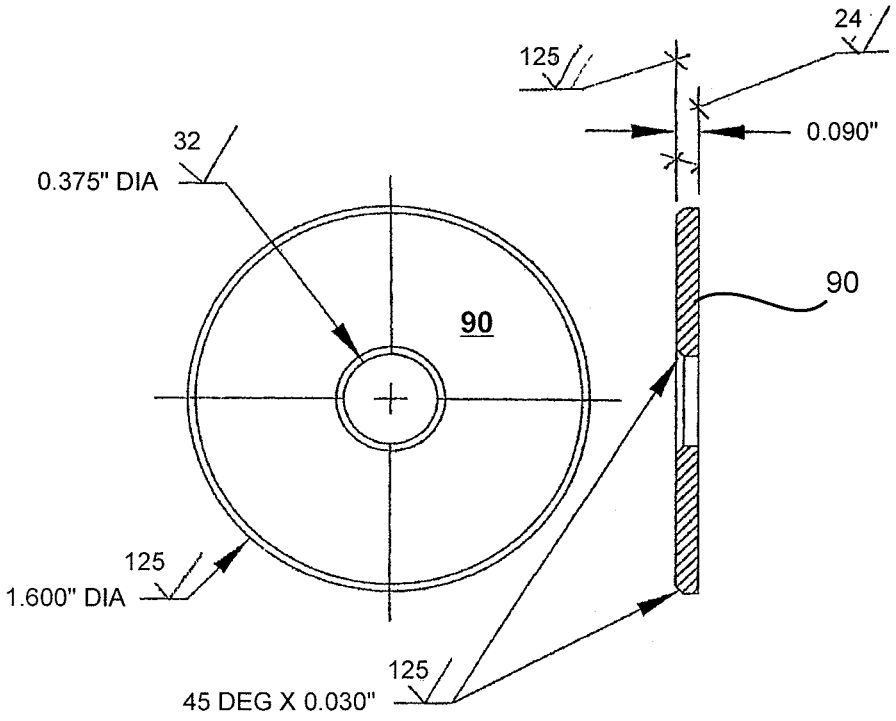
FIG. 11 includes a top view and a cross-sectional view of the wear resistant insert of FIGS. 9 and 10.

FIGS. 9 and 10 show a housing end plate assembly 84 and a housing base plate assembly 86, respectively, for the improved housing assembly of FIG. 7, in accordance with many embodiments. The housing end plate assembly 84 includes a housing end plate 88 and a wear resistant insert 90 (shown separately in FIG. 11) received within a recess of the housing end plate 88. In a similar manner, the housing base plate assembly 86 includes a housing base plate 92 and a wear resistant insert 90 received within a recess of the housing base plate 92. The wear resistant insert 90 has a circular disk configuration with an outside diameter (1.600 inch) that exceeds the diameter (1.496 inch) of the opening in the improved housing assembly 72 so that the wear resistant insert 90 extends past and overlaps the opening. The wear resistant insert 90 has a central aperture, which accommodates the impeller shaft 52, which is supported by the housing end plate 88 and the housing base plate 92. The wear resistant insert 90 provides a wear resistant surface, which resides immediately adjacent to and can interface with a majority of the area of an end face of the flexible impeller 50. For example, in the embodiment shown, the wear resistant surface interfaces with at least 95 percent of the area of the adjacent end face of the flexible impeller 50.

The housing end plate 88 and the housing base plate 92 can be made from a suitable material. For example, when the pump is used to transfer a hot food condiment, the housing end plate 88 and the housing base plate 92 can be made from a suitable food grade material (e.g., acetal thermoplastic with 13 percent Teflon FDA grade).

The wear resistant inserts 90 can be made from a suitable material. For example, when the pump is used to transfer a hot food condiment, the wear resistant inserts 90 can be made from a food grade material (e.g., AL995 FDA grade hard fired alumina ceramic).

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The term "force" is to be construed as encompassing both force and torque (especially in the context of the following claims), unless otherwise indicated herein or clearly contradicted by context. The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A flexible impeller pump, comprising:

a shaft configured to rotate about an axis thereof;

a rotor, coaxial with and attached to the shaft, configured to be rotated by the shaft, and including a plurality of vanes extending substantially radially there from, the rotor having a first end face and a second end face opposite to the first end face, the first and second end faces being perpendicular to the axis;

a housing defining an opening with the rotor disposed therein, and defining a fluid inlet and a fluid outlet, the opening including a cam surface operationally disposed between the outlet and the inlet, the cam surface being configured to interfere with the vanes to bend the vanes toward the outlet, the housing including a first end wall and a second end wall that bound the opening in an axial direction thereof, wherein the shaft and the rotor are configured to rotate relative to the housing; and a first wear resistant insert made from food grade material disposed between the rotor first end face and the first end wall, the first wear resistant insert being received within a recess of the first end wall such that the shaft and the rotor are configured to rotate relative to the first wear resistant insert, the first wear resistant insert having greater wear resistance than the housing first end wall, wherein the shaft includes first and second cylindrical portions and an impeller interface portion disposed there between, the impeller interface portion including a plurality of protruding portions distributed around the shaft, the plurality of protruding portions have a stepped cross-sectional shape along the axis of the shaft, and wherein the rotor is configured to fit around the impeller interface portion such that the plurality of protruding portions having the stepped cross-sectional shape are provided between the first end face and the second end face of the rotor.

2. The pump of claim 1, wherein the first wear resistant insert resides immediately adjacent to at least 95 percent of the area of the rotor first end face.

3. The pump of claim 1, wherein the insert includes a food grade ceramic material.

4. The pump of claim 1, comprising a second wear resistant insert disposed between the rotor second end face and the housing second end wall, the second wear resistant insert residing immediately adjacent to a majority of the area of the rotor second end face, the second wear resistant insert having greater wear resistance than the housing second end wall.

5. The pump of claim 1, wherein the cam surface has no convex curvature.

6. A flexible impeller pump, comprising:

a shaft configured to rotate about an axis thereof, the shaft including first and second cylindrical portions and an impeller interface portion disposed there between, the impeller interface portion including a portion that protrudes by at least 20 percent of the cross-sectional dimension of a central portion of the shaft impeller interface portion, wherein the impeller interface portion includes a plurality of protruding portions distributed around the shaft, wherein the plurality of protruding portions of the impeller interface portion have a stepped cross-sectional shape along the axis of the shaft;

a rotor, coaxial with the shaft and attached to the shaft interface portion, configured to be rotated by the shaft, and comprising a main body and a plurality of vanes extending substantially radially from the main body, wherein each of the protruding portions is aligned with one of the vanes, wherein the rotor is configured to fit around the impeller interface portion such that the plurality of protruding portions having the stepped cross-sectional shape are provided between a first end face and a second end face of the rotor; and a housing defining an opening with the rotor disposed therein, and defining a fluid inlet and a fluid outlet, the opening including a cam surface operationally disposed between the outlet and the inlet, the cam surface being configured to interfere with the vanes to bend the vanes toward the outlet.

7. The pump of claim 6, wherein each of the portions protruding by at least 10 percent of the cross-sectional dimension of the central portion of the shaft impeller interface portion.

8. The pump of claim 6, wherein the number of the protruding portions equals or exceeds the number of the vanes.

9. The pump of claim 6, wherein the shaft impeller interface portion includes a plurality of rows of the protruding portions, wherein the plurality of rows extend perpendicular to the axis of the shaft.

10. The pump of claim 6, wherein each of the protruding portions has a constant cross-sectional shape and is aligned with the shaft axis.

11. The pump of claim 6, wherein each portion of the rotor main body disposed between a pair of adjacent the vanes has an external surface having no convex curvature from one of the pair of the vanes to the other of the pair of the vanes.

12. The pump of claim 11, wherein each of the main body external surfaces has a concave shape having a substantially constant radius.

13. The pump of claim 6, wherein the cam surface has no convex curvature.

* * * * *